United States Patent [19]

Weitzel et al.

[11] Patent Number: 4,960,492

[45] Date of Patent: Oct. 2, 1990

[54] COMMON WIRE PATH OF A WET END SECTION OF A TWIN WIRE PAPER MAKING MACHINE

[75] Inventors: Wolfgang Weitzel; Dieter Egelhof, both of Heidenheim, Fed. Rep. of Germany

[73] Assignee: J.M. Voith GmbH, Fed. Rep. of Germany

[21] Appl. No.: 306,514

[22] Filed: Feb. 3, 1989

[30] Foreign Application Priority Data

Feb. 9, 1988 [DE] Fed. Rep. of Germany ..... 3803805

[51] Int. Cl.[5] ..... D21F 1/00

[52] U.S. Cl. ..... 162/301; 162/300; 162/303

[58] Field of Search ..... 162/300, 301, 303, 348, 162/352

[56] References Cited

U.S. PATENT DOCUMENTS

| | | | |
|---|---|---|---|
| 3,726,758 | 4/1973 | Parker et al. | 162/299 |
| 3,839,143 | 10/1974 | Suckow | 162/301 |
| 3,884,756 | 5/1975 | Gustafson | 162/300 |
| 3,944,464 | 3/1976 | Means | 162/301 |
| 3,944,774 | 11/1976 | Halme et al. | 162/301 |
| 4,113,556 | 9/1978 | Kankaanpaa | 162/301 |
| 4,609,435 | 9/1986 | Tissari | 162/301 |
| 4,623,429 | 11/1986 | Tissari | 162/301 |
| 4,686,004 | 8/1987 | Fujiwara | 162/301 |
| 4,790,909 | 12/1988 | Harwood | 162/301 |

FOREIGN PATENT DOCUMENTS

| | | | |
|---|---|---|---|
| 3222428 | 12/1983 | Fed. Rep. of Germany | 162/301 |
| 1336713 | 11/1973 | United Kingdom | 162/301 |

OTHER PUBLICATIONS

"Zellstoff und Papier", 1979, Edition 4, p. 176.

*Primary Examiner*—Karen M. Hastings

*Attorney, Agent, or Firm*—Ostrolenk, Faber, Gerb & Soffen

[57] ABSTRACT

The invention relates to a wet end section of a twin wire paper machine. Each wire forms a wire loop. The wires are led together along a vertical, rising, common path, which starts at a wedge shaped feed nip at the bottom of the common path. The nip is formed by the two wires and is defined by a forming cylinder arranged in the loop of the inner wire. Inside the other outer wire, there is a fixed curved surface or outer surface having a center of curvature which lies on one side of the rising common wire path. A further curved inner surface which follows the outer surface along the wire path is provided on a doctor blade carrier or pivotable cross-beam located inside the loop of the inner wire. This is followed by a suction roll arranged in the loop of the outer wire. The length of the further inner surface is shorter than the length of the outer surface.

16 Claims, 1 Drawing Sheet

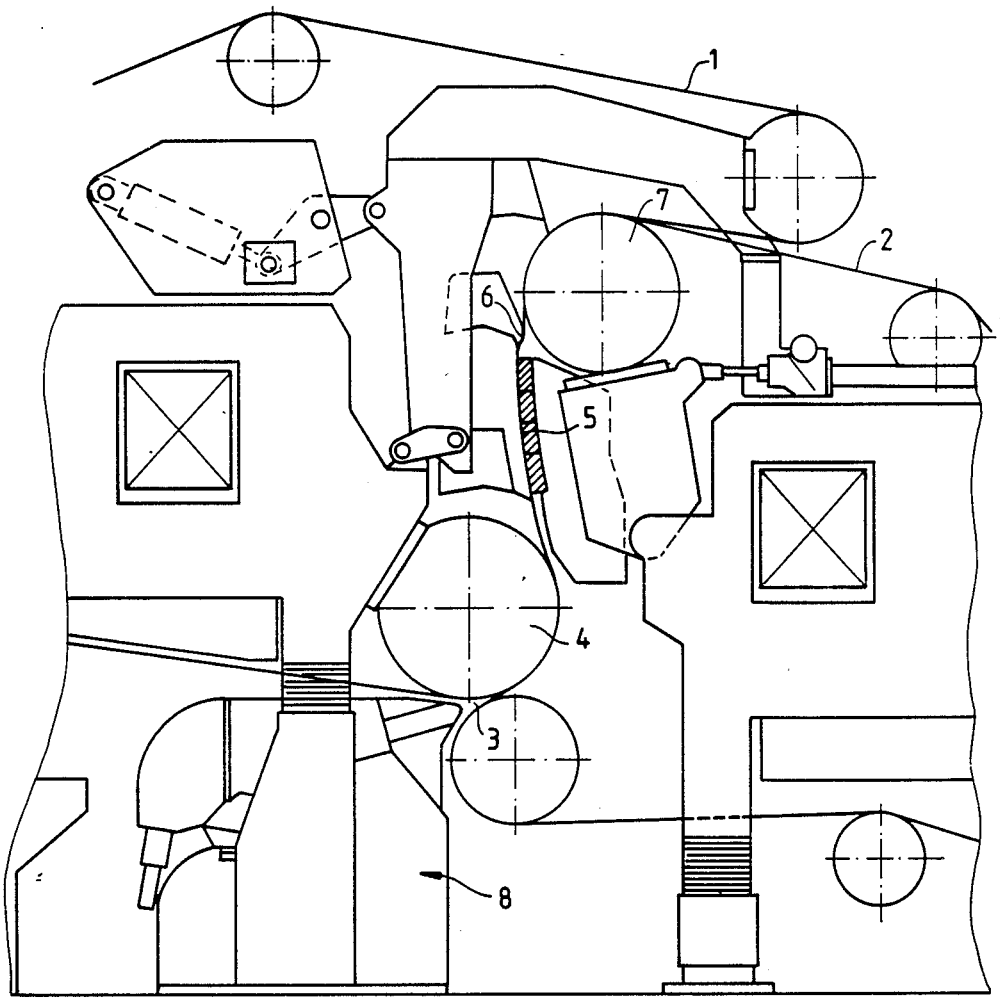
1
2
3
4
5
6
7
8

COMMON WIRE PATH OF A WET END SECTION OF A TWIN WIRE PAPER MAKING MACHINE

BACKGROUND OF THE INVENTION

The invention relates to a wet end section or forming section of a twin wire paper making machine and more particularly relates to the supports guiding movement of the wires at and after the feed nip. Such a wet end section is known from Zellstoff and Papier, 1979, issue 4, page 176 (see FIG. 4 therein).

Dewatering the web is an important function performed in the wet end section of a paper making machine. The above reference (as well as U.S. Pat. No. 3,726,758) discloses dewatering by deflection of the wires, which applies centrifugal force.

Machines of this type have proved very successful . The make it possible to manufacture paper webs having good formation and having only a slight degree of two sideness. However, since requirements in this respect have increased, improvements are desirable.

SUMMARY OF THE INVENTION AND BRIEF DESCRIPTION OF THE DRAWING

The drawing shows the wet end section of a paper making machine.

The invention as the object of providing a wet end section of the type described above wherein the quality of the paper web produce, in particular the two sidedness and the look-through (or "cloudiness") of the paper, are improved.

Another object is to dewater the web through both of the wires.

A further object is to dewater, in part, by centrifugal force.

Preferably, the arrangement is such that the two wires are subjected to an alternating curvature along their common rising path. Consequently, the headbox sprays pulp stock for dewatering into a feed nip at the bottom of the common path. The headbox is followed by and one side of the feed nip is shaped by the forming cylinder, which is provided with a perforated jacket and is disposed inside the loop of the inner wire. That forming cylinder receives and then deflects the two wires in a first direction around the forming cylinder. The cylinder is followed, at a greater or lesser distance, by a curved outer surface, which is disposed inside the loop of the outer wire and deflects the two wires in the second or opposite direction from the first direction. The outer surface in turn is followed by a curved inner surface which is disposed inside the loop of the inner wire. The inner surface deflects the wires in the first direction. According to the invention, the length (along the twin wire common path) of the curved inner surface is much shorter than the length of the curved outer surface. Finally, there follows a suction roll, also known as a wire suction roll, which is disposed inside the loop of the outer wire and once again changes the direction of wire deflection. Thereafter the wire loops follow their separate paths.

In the case of the prior art, dewatering has been left to the forming cylinder and to but a single existing outer surface. See, e.g. U.S. Pat. No. 3,726,758. Lengthening that outer surface along the wire path beyond a certain extent has not caused any further dewatering. It has been found that the differently curved outer and inner surfaces according to the invention once again causes dewatering to an unexpectedly large disproportionate extent. Moreover, the quality of the paper web, in particular with respect to its two sidedness and its look-through, is distinctly improved.

Other objects and features of the present invention will become apparent from the following description of a preferred embodiment of the invention considered in conjunction with the accompanying drawing which diagrammatically illustrates the wet end section of a paper making machine.

DESCRIPTION OF A PREFERRED EMBODIMENT

The wet end section of a paper making machine, as shown in the drawing, comprises an inner screen called an inner wire 1 and an outer screen called an outer wire 2. Each wire is in the form of a respective endless loop. Each wire is supported by a respective series of guide rolls, as is conventional. The wires are led together by elements of the invention 4–7, as described below, along a certain length of a common path. A part of this length of path runs approximately vertically from the bottom to the top of the wet end section. An inclination from the vertical, for example at an angle of up to 30°, is likewise conceivable.

The common length of the paths of both wires 1 and 2 begins with a wedge shaped feed nip 3 at the bottom of the path in the wet end section. A forming cylinder 4 is located at and helps define the feed nip. The cylinder 4 is wrapped over a larger arc of its periphery by the inner wire 1, whereby the cylinder 4 supports the wire 1 to define its side of the feed nip 3. A separate roll 9 inside the outer wire 2 and opposite the forming cylinder 4 directs the outer wire 2 into the feed nip to define that side of the feed nip. The cylinder 4 is wrapped around a smaller arc of its periphery by both wires 1, 2. As can be seen in the drawing, the common path of the wires wraps around about a quarter of the outer surface of the forming cylinder. There it defines the start of the common path of the wires and also dewaters the web through the outer wire 2 by centrifugal force.

A wire frame or forming board 5' is located inside the loop formed by the outer wire 2 downstream from the forming cylinder 4 along the common path. This wire frame 5' has a fixed position curved outer surface 5 over which the wires 1, 2 pass and by which they are deflected to the left in the drawing to dewater the web through the inner wire 1 by centrifugal force. The surface 5 is made up of a plurality of strips, which are arranged to extend transversely to the running direction of the two wires 1, 2 and which are arranged in sequence along the running direction. The inner surface of the outer wire 2 slides over the strips of surface 5. The surface 5 is curved in such a way that the center or centers of its curvature or curvatures is located, in the drawing, to the right of the common vertical length of the path of the two wires 1, 2.

The first curved outer surface 5 is followed at a short distance along the common wire path by a second curved or inner surface 6. The inner surface 6 is curved such that the center or centers of its curvature or curvatures is located to the left (as viewed in the drawing) of the common vertical length of path of the two wires 1, 2. In the preferred embodiment the inner surface 6 is formed on a doctor blade carrier or beam 6, which extends over the entire width of the wires 1, 2 and across the path of the wires. The doctor blade carrier can be inclined or tilted, as by pivoting around an axis across the width of the wet end section, in such a way that the pressure exerted by the inner surface 6 the two wires 1, 2, can be increased or deceased depending upon the angle of incline of the surface 6. This enables the second surface to be moved selectively further into and out of the common path of the wires, such that the second surface is movable to deflect the wires selectively more or less. This curvature of the inner surface 6 gives rise to a further dewatering into the inside of the loop of the outer wire 2. Dewatering toward the other side, on the other hand, that is into the inside of the loop of the inner wire 1, is prevented to a great extent in this region.

At the end of the common length of path of the two wires 1, 2 is located a wire suction roll 7. It likewise has a perforated roll jacket. As can be seen, the two wires 1, 2 separate on the jacket of the wire suction roll 7, and to be precise, directly after the upper crest of the roll.

A headbox 8 is located in such a position that it produces a jet of pulp or stock equal to the width of the machine into the feed nip 3. The stock then follows the described common path of the two wires 1, 2, where it is dewatered to the extent necessary. At the end of the wire suction roll 7, a fiber mat issues, which adheres to the outer wire 2 and is fed by that wire to a press (not shown).

As seen in the wire running direction, the length of the curved inner surface 6 is only a fraction of the length of the outer surface 5, e.g. 1/20 and 1/10 of the length of surface 5, or substantially 1/10 or less of surface 5. Thus, the outer surface 5 may, for example, be 1.4 m long while the inner surface 6 only has a length of 5 cm.

In contrast to the exemplary embodiment shown, the outer surface 5 may be completely closed and consequently water impermeable. The curved inner surface 6 is usually closed. In exceptional cases, the surface 6 may, however, be designed similarly to the outer surface 5, i.e. the surface 6 may be made up of individual strips or foils.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A wet end section of a paper making machine, comprising:

a pair of paper machine wet end section wires including an inner wire forming a first wire loop and an outer wire cooperating with the inner wire and forming a second wire loop;

means for supplying stock for dewatering and including a stock outlet;

a forming cylinder arranged inside the first loop of the inner wire so that the inner wire wraps partially around the forming cylinder; means for directing the outer wire to meet the inner wire at the forming cylinder for defining a feed nip at the forming cylinder, and the stock outlet being directed to dispense stock into the feed nip; the wires having a common path of movement from the feed nip and along the outer surface of the forming cylinder which deflects the wires in a first direction;

a first curved surface following the forming cylinder, the common path of the wires extending over the first curved surface, the first curved surface being inside the loop of the outer wire, the first curved surface being shaped and oriented such that the wire path is curved in a second direction opposite the first direction of curvature of the wire path around the forming cylinder;

a second curved surface further along the common path of the wires past the first curved surface, said second curved surface being disposed inside the loop of the inner wire, the common path of the wires extending over the second curved surface, the second curved surface being so curved and positioned that the wires moving along the common path past the second curved surface are deflected in the first direction opposite to the second direction of curvature of the wires passing over the first curved surface; the length of the second curved surface along the common path of the wires being substantially 1/10 or less of the length of the first curved surface along the common path of the wires;

a doctor blade carrier supported in the wet end section and inside the first loop of the inner wire and extending across the common path of the wires, the second curved surface being defined on the doctor blade carrier; the doctor blade carrier being tiltable with respect to the wires for moving the second surface selectively further into and out of the common path of the wires, such that the second surface is movable to deflect the wires selectively more or less in said first direction;

a suction roll located inside the second loop of the outer wire, the suction roll being disposed along the common path of the wires past the second curved surface, the common path of the wires extending over the outer surface of the suction roll; and means supporting the wires for separating into the respective first and second loops following the second curve surface.

2. The wet end section of claim 1, wherein the common path of the wires from the feed nip past the second surface is defined by the positioning of the forming cylinder, the first surface and the second surface to define a rising section wherein the common path of the wires is generally vertically upward.

3. The wet end section of claim 1, wherein the means supporting the wires for separating into the respective first and second loops comprises the wires partially wrapping the suction roll.

4. The wet end section of claim 2, wherein the first curved surface is generally arcuate in shape and generally includes a center of curvature which lies to the side of the common path of the wires that is inside the second loop of the outer wire; and the second curved surface is generally arcuate and generally includes a center of curvature which is located on the other side of the common path of the wires inside the first loop of the inner wire.

5. The wet end section of claim 1, wherein the length of the second curved surface along the common path of the wires is in the range of 1/20 to 1/10 of the length of the first curved surface along the path of the wires.

6. The wet end section of claim 2, further comprising additional support means for supporting the first loop of the inner wire and for supporting the second loop of the outer wire for moving in a loop pathway 7. The wet end section of claim 6, wherein the additional support means of the second loop of the outer wire comprises a roll disposed inside the second loop of the outer wire and positioned at the feed nip for the outer wire to wrap around at the feed nip such that the additional roll directs the outer wire into the feed nip while the forming cylinder directs the inner wire to the feed nip.

8. The wet end section of claim 1, wherein said first curved surface is stationary.

9. The wet end section of claim 1, wherein said common path of said wires wraps around about a quarter of the outer surface of said forming cylinder.

10. The wet end section of claim 1, wherein said common path of said wires is deflected into a generally vertical direction by said forming cylinder.

11. The wet end section of claim 1, wherein said common path of said wires is deflected into a generally horizontal direction by said suction roll.

12. A wet end section of a paper making machine, comprising:

a pair of paper machine wet end section wires including an inner wire forming a first wire loop and an outer wire cooperating with the inner wire and forming a second wire loop;

means for supplying stock for dewatering and including a stock outlet;

a forming cylinder arranged inside the first loop of the inner wire so that the inner wire wraps partially around the forming cylinder; means for directing the outer wire to meet the inner wire at the forming cylinder for defining a feed nip at the forming cylinder, and the stock outlet being directed to dispense stock into the feed nip; the wires having a common path of movement from the feed nip and along the outer surface of the forming cylinder which deflects the wires in a first direction;

a first curved surface following the forming cylinder, the common path of the wires extending over the first curved surface, the first curved surface being inside the loop of the outer wire, the first curved surface being shaped and oriented such that the wire path is curved in a second direction opposite the first direction of curvature of the wire path around the forming cylinder;

a second curved surface further along the common path of the wires past the first curved surface, said second curved surface being disposed inside the loop of the inner wire, the common path of the wires extending over the second curved surface, the second curved surface being so curved and positioned that the wires moving along the common path past the second curved surface are deflected int he first direction opposite to the second direction of curvature of the wires passing over the first curved surface;

the length of the second curved surface along the common path of the wires being substantially 1/10 or less of the length of the first curved surface along the common path of the wires;

a doctor blade carrier supported in the wet end section and inside the first loop of the inner wire end extending across the common path of the wires, the second curved surface being defined on the doctor blade carrier; the doctor blade carrier being tiltable with respect to the wires for moving the second surface selectively further into and out of the common path of the wires, such that the second surface is movable to deflect the wires selectively more or less in said first direction; and means supporting the wires for separating into the respective first and second loops following the second curved surface.

13. The wet end section of claim 12, further comprising a suction roll located inside the second loop of the outer wire, the suction roll being disposed along the common path of the wires past the second curved surface, the common path of the wires extending over the outer surface of the suction roll.

14. The wet end section of claim 12, wherein said common path of said wires wraps around about a quarter of the outer surface of said forming cylinder.

15. The wet end section of claim 12, wherein said common path of said wires is deflected into a generally vertical direction by said forming cylinder.

16. The wet end section of claim 13, wherein said common path of said wires is deflected into a generally horizontal direction by said suction roll.

* * * * *